US006774797B2

(12) United States Patent
Freathy et al.

(10) Patent No.: US 6,774,797 B2
(45) Date of Patent: Aug. 10, 2004

(54) WIRELESS TAG AND MONITORING CENTER SYSTEM FOR TRACKING THE ACTIVITIES OF INDIVIDUALS

(75) Inventors: Stephen Freathy, Blakeney (GB); Stephen Lane, Hugerford (GB)

(73) Assignee: On Guard Plus Limited, Surrey (GB)

( * ) Notice: Subject to any disclaimer, the term of this patent is extended or adjusted under 35 U.S.C. 154(b) by 0 days.

(21) Appl. No.: 10/144,236

(22) Filed: May 10, 2002

(65) Prior Publication Data

US 2003/0210142 A1 Nov. 13, 2003

(51) Int. Cl.[7] ..... G08B 23/00

(52) U.S. Cl. ..... 340/573.1; 340/539.13; 340/693.5; 340/825.49; 455/404.2

(58) Field of Search ..... 340/573.1, 573.4, 340/573.3, 539.11, 539.13, 539.16, 539.31, 539.19, 693.5, 568.1, 572.1, 825.49; 455/404.2

(56) References Cited

U.S. PATENT DOCUMENTS

| | | | | | |
|---|---|---|---|---|---|
| 4,747,120 | A | * | 5/1988 | Foley | 340/825.36 |
| 4,777,477 | A | | 10/1988 | Watson | 340/573 |
| 4,885,571 | A | | 12/1989 | Pauley et al. | 340/573 |
| 4,918,425 | A | | 4/1990 | Greenberg et al. | 340/539 |
| 4,918,432 | A | | 4/1990 | Pauley et al. | 340/573 |
| 5,204,670 | A | | 4/1993 | Stinton | 340/825.54 |
| 5,461,365 | A | | 10/1995 | Schlager et al. | 340/573 |
| 5,461,390 | A | | 10/1995 | Hoshen | 342/419 |
| 5,471,197 | A | * | 11/1995 | McCurdy et al. | 340/573.1 |
| 5,552,772 | A | | 9/1996 | Janky et al. | |
| 5,568,119 | A | | 10/1996 | Schipper et al. | |
| 5,650,770 | A | | 7/1997 | Schlager et al. | 340/573 |
| 5,652,570 | A | | 7/1997 | Lepkofkor | 340/573 |
| 5,712,619 | A | | 1/1998 | Simkin | 340/539 |
| 5,714,931 | A | | 2/1998 | Petite et al. | 340/539 |
| 5,731,757 | A | * | 3/1998 | Layson, Jr. | 340/573.1 |
| 5,742,233 | A | | 4/1998 | Hoffman et al. | 340/573 |
| 5,742,509 | A | | 4/1998 | Goldberg et al. | 364/449.5 |
| 5,825,283 | A | | 10/1998 | Camhi | 340/438 |
| 5,838,237 | A | | 11/1998 | Revell et al. | 340/573 |
| 5,867,103 | A | | 2/1999 | Taylor, Jr. | 340/573 |
| 5,870,029 | A | | 2/1999 | Otto et al. | 340/825.6 |
| 5,892,454 | A | | 4/1999 | Schipper et al. | 340/825.37 |
| 5,959,533 | A | | 9/1999 | Layson, Jr. | 340/573.1 |
| 6,014,080 | A | * | 1/2000 | Layson, Jr. | 340/573.1 |
| 6,054,928 | A | | 4/2000 | Lemelson et al. | 340/573.4 |
| 6,072,396 | A | * | 6/2000 | Gaukel | 340/573.4 |
| 6,100,806 | A | | 8/2000 | Gaukel | 340/573.4 |
| 6,104,295 | A | | 8/2000 | Tenarvitz et al. | |
| 6,181,253 | B1 | | 1/2001 | Eschenbach et al. | 340/825.37 |
| 6,198,431 | B1 | * | 3/2001 | Gibson | 342/357.07 |
| 6,239,700 | B1 | | 5/2001 | Hoffman et al. | 340/559 |
| 6,278,370 | B1 | * | 8/2001 | Underwood | 340/573.1 |
| 6,606,556 | B2 | * | 8/2003 | Curatolo et al. | 701/207 |
| 2001/0048364 | A1 | | 12/2001 | Kalthoff et al. | |

FOREIGN PATENT DOCUMENTS

| | | | |
|---|---|---|---|
| GB | 2279170 A | 12/1994 | G08B/13/14 |

* cited by examiner

*Primary Examiner*—Jeffery Hofsass
*Assistant Examiner*—David Previl
(74) *Attorney, Agent, or Firm*—ZITO tlp; Joseph J. Zito; Kendal M. Sheets

(57) ABSTRACT

A tracking tag worn by an individual which cooperates with a monitoring center to monitor the location of individuals. The tracking tag has a number of location determination features, including GPS and cellular geolocation methods. The tag includes a processor, flash memory, a wireless modem, a GPS receiver and tamper detection components. The tags of the system provide location information to the monitoring center on a regular periodic basis. The monitoring center maintains historical data of tag location correlated with tag positional information from both the GPS and cellular systems to enhance the verification of real-time positional information as it is received in real time from the tags. The system allows for a complex set of permissible and impermissible activities for the tag wearer and provides for detection and notification of violations.

17 Claims, 5 Drawing Sheets

WIRELESS TAG AND MONITORING CENTER SYSTEM FOR TRACKING THE ACTIVITIES OF INDIVIDUALS

BACKGROUND OF THE INVENTION

The present invention relates to the tracking of individuals to maintain knowledge of their location. More specifically, present invention relates to a lightweight tracking tag which can be worn by an individual.

Electronic monitoring of individuals such as offenders, has primarily relied upon electronic monitoring at a fixed located such as the offenders home or place of employment. These systems relied upon a land line telephone link and are commonly known as house arrest systems. These systems utilized a body worn transmitter which could not be removed by the offender and a stationary receiver located at the monitoring location. The body worn portion of the device transmits a signal a short distance to the receiver located at the monitoring location. The receiver communicates with a central monitoring service over standard telephone lines. The tracking system of this type is limited in that it can only provide an indication of the presence or absence of the offender at the monitored location at a given time. This type of system cannot offer location information if the offender leaves the monitored location.

Other systems with greater portability have also been used to collect information regarding the present location of a tracked individual. For example, U.S. Pat. No. 5,731,757 teaches a portable device for tracking and offender's position. The tracking apparatus of this patent includes a small body worn non-removal portion and a larger heavier portable portion not attached to the offenders body. The larger portable portion keeps track of location, while the smaller body worn portion ensures that the offender is close to the larger portable device. This type of system proves not only cumbersome but limiting in that the individual being tracked must carry the large portable device which is noticeable to others.

Other devices exist which attempt to combine the functions of the large portable unit and the body worn transmitter into a single unit. Devices which attempt to achieve this combination are taught in U.S. Pat. Nos. 5,712,619; 5,497,149; 6,014,080 and 5,742,233. These devices lack the functionality and versatility of the present invention to properly track individuals in a variety of conditions and provide comprehensive monitoring

SUMMARY OF THE INVENTION

The present invention is a one-piece lightweight waterproof personal tracking tag which is attached to an individual using either a tamper detection strap or other suitable means of connection. The tag communicates with a global positioning satellite network and a wireless network to obtain geographic location information and to exchange data with a centralized data system. The tag monitors the location of the wearer of the tag, compares the monitored location to a database of acceptable and unacceptable location and time parameters and provides updates to a centralized database system, the monitoring center, and receives downloads and updates from the system.

In order to track one or more offenders, each of which having an individual set of allowed geographic and temporal restrictions, the system must maintain an extensive database of offenders and corresponding restrictions. The tag incorporates a processor, flash memory, a cellular modem, a GPS receiver, tamper detection, and a rechargeable battery into a single lightweight unit. One or more offenders are provided with a tracking tag. Each of the tags reports into the monitoring center 30 on a periodic basis. The reporting basis can be on a predetermined schedule and/or can be based upon detection of a violation or other reportable condition detected by the tag itself. Information reporting by the various tags is recorded and analyzed at the monitoring center by the data tracking system to determine if offender violations have occurred. The centralized data tracking system can then take an appropriate action to notify, respond to and/or correct the noted violation.

DETAILED DESCRIPTION OF AN EXEMPLARY EMBODIMENT

Figure 1:
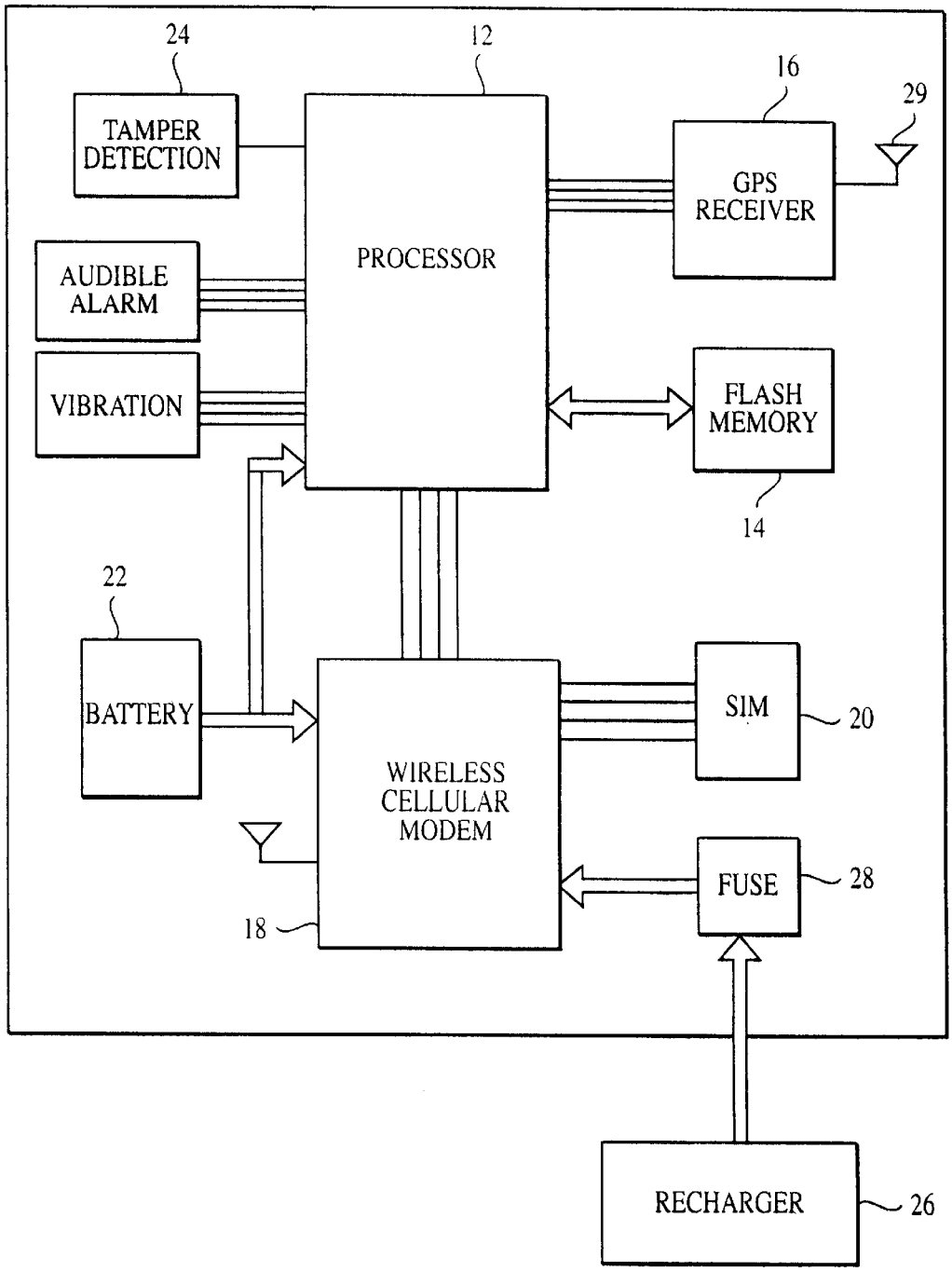
FIG. 1 is a functional block diagram of the wearable tag portion of the present invention.
Figure 2:
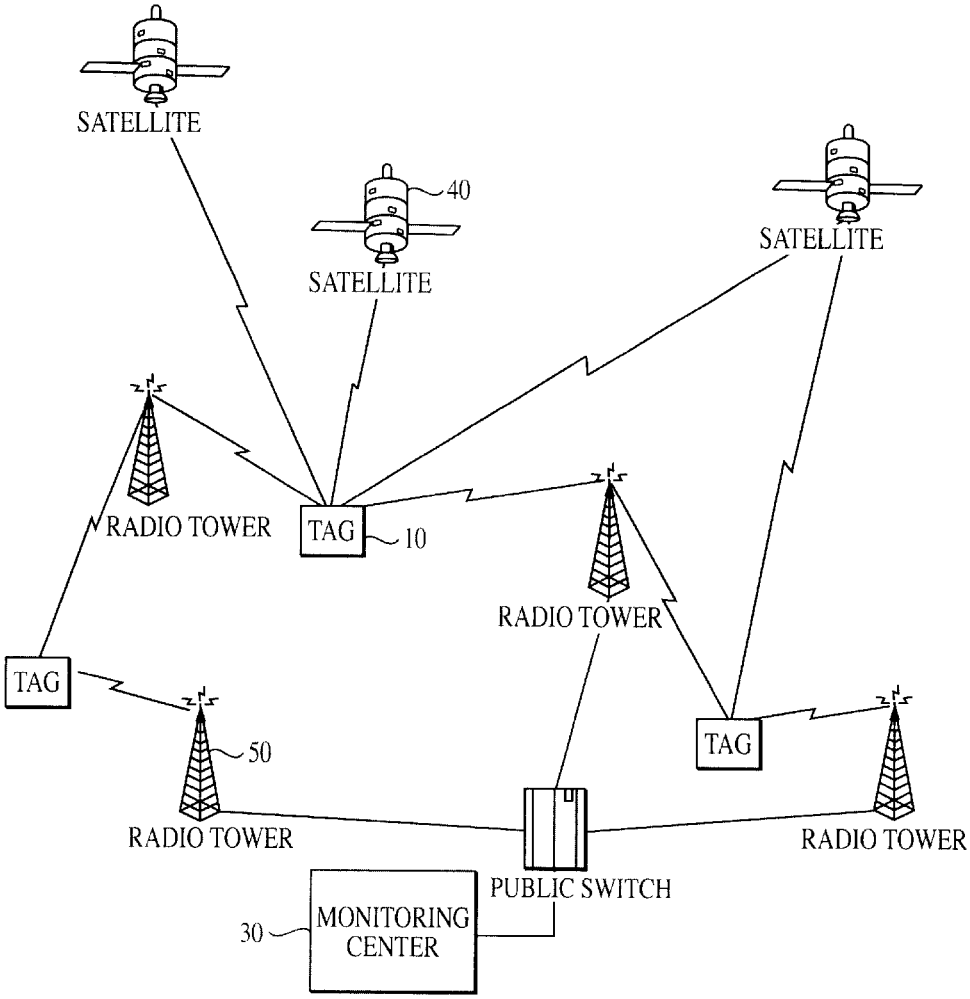
FIG. 2 is an overall diagram of the system.
Figure 4:
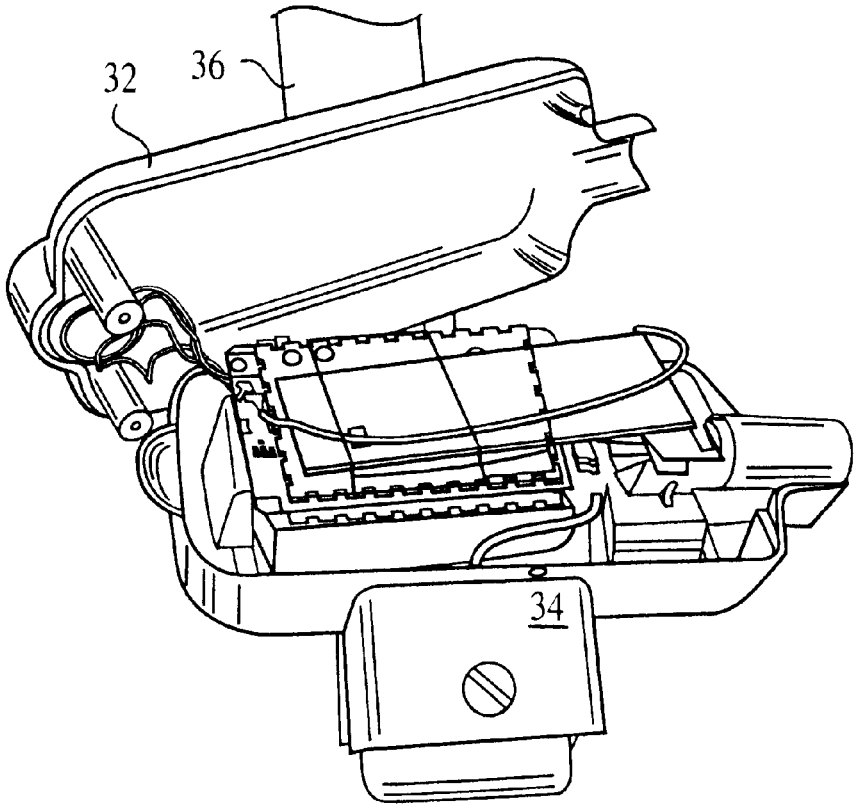
FIGS. 4 and 5 are perspective views of the tag opened to illustrate its components
Figure 5:
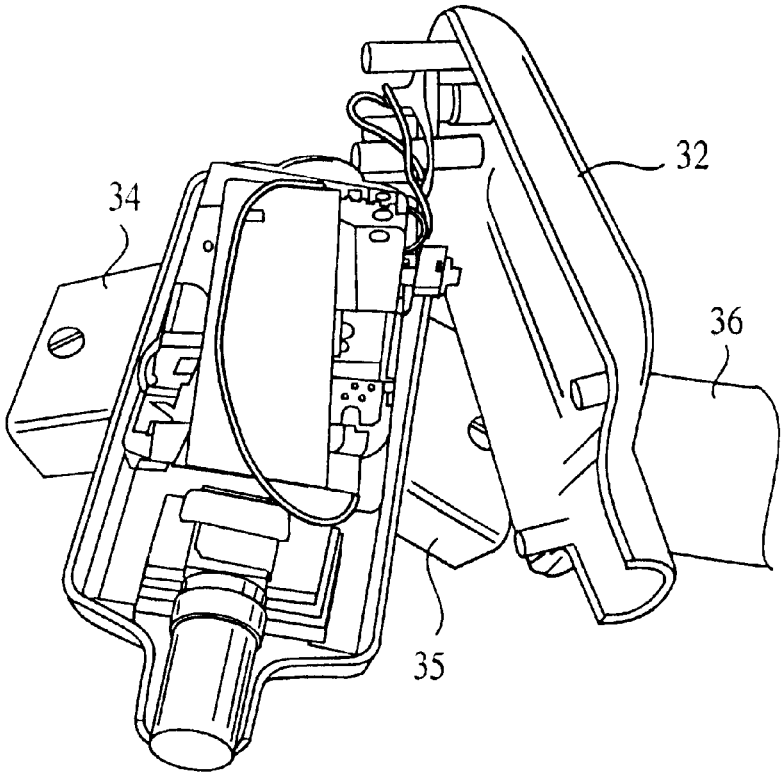

As illustrated in FIGS. 1, 4 and 5, the tag has a processor 12, flash memory 14 associated with the processor 12 and a GPS module 16 which provides up GPS position information to the processor 12. A cellular modem 18 with an associated SIM card 20 provided for data communication between the tag 10 and the central data tracking system 30. As illustrated in FIG. 2, the tag 10 communicates through a wireless system 50 with the central data processing system 30. The tag 10 also communicates with one or more GPS satellites 40. The tag can obtain position information either through the GPS system 40 and/or through position determination techniques utilized in the wireless network 50. Wireless systems techniques for geographic location determination, commonly referred to in wireless industry as geolocation, can include triangulation, and estimated time of delivery based upon the cellular ID of the base stations from which a signal is received.

Several methods for determining the location of a wireless unit within a cell system have been developed and deployed with varying accuracy and success. Wireless location systems can be handset-based in that the hand set acquires information about its position either relative to one or more cell sites. The mobile unit makes an internal determination of its location and provides this information to the wireless system. Wireless location systems can also be network-based wherein the individual cells of the network obtain information about the location of the mobile unit relative to the individual cell sites and the network determines the location of the mobile unit by combining the information from the cell sites to triangulate the location of the mobile unit. For example, the difference in the time of arrival of the signal at each cell site or the difference in the phase angle of arrival at each cell site can be used to determine position. If a networked based form of geolocation is used, the location of the tag can be sent directly to the monitoring center 30 or can be passed to the tag and then relayed to the monitoring center.

Geolocation has found widespread application in the field of E-911 and E-411 services offered to cellular communication systems and subscribers. Examples of the application of geolocation of mobile wireless units can be found in the devices of True Position, Grayson Wireless Geometrix, SigmaOne, U.S. Wireless, CellLoc and others. The paper Time Difference of Arrival Technology for Locating Narrowband Cellular Signals www.trueposition.com/TDOA_Overview.htm, incorporated herein by reference, provides a technical explanation of the aspects of geolocation implementation.

Examples of handset-based wireless location systems include enhanced observed time difference EOTD also referred to as estimated time of departure. In enhanced time of departure, the mobile unit determines the time period for travel of a signal from one or more cell towers to the mobile unit. By determining the time of travel, the mobile unit can estimate its distance from one or more cell sites and triangulate its location.

Examples of network-based wireless location systems include estimated time of arrival and estimated angle of arrival. Each of these methods rely on assumed propagation models to determine distance based upon the time traveled by a cellular signal between a cell site and a mobile unit.

One geolocation systems is described in U.S. Pat. No. 5,327,144. This patent teaches a cellular telephone location system for automatically recording the location of one or more mobile cellular telephones using three or more cell sites. This patent relies upon a measurement at a number of cell sites of the different arrival times of a signal from a wireless mobile unit. Other representative systems include U.S. Pat. No. 6,011,974 which relies upon the calculation of the time of a round-trip to determine the distance between a mobile unit and a base site using the apparent uplink and down link signal propagation times. U.S. Pat. Nos. 6,006,096 and 6,052,598 teach that the difference in power levels of an uplink signal from a mobile unit received at a number of cell sites can be used to determine location through triangulation.

The tag also includes a battery 22 to power the processor 12, the cellular modem 18, the GPS receiver 16 and the other components within the tag 10. The battery 22 resides within the unit in a sealed compartment and is not removed for recharging so as to avoid potential leaks which could result from removal and replacement of the battery. Because the unit must be worn by an offender at all times, the tag will be subjected to water in such environments as showering. The battery 22 is instead recharged while it remains within the tag unit 10 by means of recharger 26.

The tag also includes a tamper detection mechanism 24 to avoid unauthorized removal or opening of the tag.

The microprocessor 12 controls the operation of the tag 10. Regular poles of the cellular modem 18 and GPS receiver 16 are carried out to monitor for incoming command messages and to monitoring the location of the tag. The parameters of the monitoring to be performed are programmed into the processor 12 to respond to variations in the location of the tag and to respond to commands received from the main data system 30 through the cellular modem 18.

The flash memory 14 holds the programmed code for the operation of the tag. The code is downloaded to the unit utilizing a serial link and can be modified and/or downloaded through the cellular modem connection 18. To perform a preliminary downloaded of the code, the GSM modem 18 is disconnected from the tag and a PC interface cable adapter is fitted to connect to the processor 12. The download program protocol allows new programmed code to be downloaded from a PC running a terminal program.

Communication to the tag 10 is through the cellular modem 18. A cellular modem such as a Siemens TC35 GSM modem can be used for operation on the 900/1800 bands of the GSM cellular spectrum. During operation, the modem remains logged into the cellular network, allowing the tag to be called from the data center to request current operating status. The tag can also be polled by the monitoring data center 30 to download the position of the tag as measured by the GPS system and/or to download other operating parameters such as violation history, position history and/or battery status.

The processor 12 within the tag 10 is programmed to monitor for alarm conditions, such as violations of restrictions by the tag wearer. In the event that an alarm condition occurs, for example low battery voltage, a tamper detection by the tamper prevention unit 24 or a violation of the geographic limitations set for the wearer of the tag, the processor communicates an alarm condition to the monitoring center 30. The processor can run continuously or can be programmed to cycle the entire tag through an intermittent power pattern, such as a sleep mode, to conserve battery power.

The processor code also includes a the ability to be manually placed into a sleep mode wherein the unit is not powered down but only inactive, upon receipt of an appropriate command from the data center 30. Powering down of the tag 10 can be used to prolong the life of the battery 22. By allowing a power down to be controlled by the data center, the tag can be powered down without the knowledge of the offender. Because the offender does not know when the unit is inactive, the offender cannot take advantage of inactivity to commit an offense without detection. The unit can reactivate after a set period of time, after being connected to a recharger or after receipt of a command to reactivate.

The SIM card is sealed within the tag unit and cannot be accessed by the wearer. The card contains programing of the telephone numbers for the tag to dial for reporting or when an alarm condition occurs.

The battery is preferably a polymer lithium ion type battery to provide sufficient power and charge retention to allow for in site recharging. A external recharger is connected to a water tight connector sealed to IP68, allowing the tag to be fully submerged to a depth in excess of 10 meters. A self resetting fuse 28 is incorporated into the tag10 and is connected at the input from the recharger to prevent permanent damage or disabling of the tag by connection to an improper power source. The charge level is continuously monitored. When the charge level of the battery 22 falls below a predetermined level, the battery status will be reported to the call center.

The GPS module is preferably a u-Blox GPS-MSI receiver which is a 12 channel parallel GPS receiver and is used with a helical antenna 29 mounted internal to the tag case. The GPS module when activated will obtain the current position of the tag. If no fix is obtained, the system uses the last prior position fix. To minimize the power consumption and therefore maximize the battery charge life, the GPS receiver is used in the push to fix mode. The receiver is normally asleep and, only when requested, wakes to obtain the current position of the tag. Satellite acquisition normally takes less than six seconds, substantially reducing the power consumption of the device.

Regular positional fixes are required for optimally update the GPS receiver almanac because a cold start of the receiver can require over a minute to obtain a valid position, however regular positional fixes are not necessary for proper operation. The control of the processor 12 manages the operation of the GPS receiver 16 to maximize the power efficiency and life of the battery to obtain a full day operation between recharge cycles of the tag battery 22.

The tag 10 also collects cell ID from the wireless system through the wireless cellular modem 18 and EOTD information when provided by the network. The use of cell ID and EOTD can be used to determine the tag position, as is known in the art, however with less accuracy than the GPS receiver. The Tag can use this secondary position information as a confirmation of the fix obtained by the GPS receiver or as a substitute for the GPS positioning when a GPS position is unavailable.

The tag can include an audible alarm such as a buzzer or a vibrating alert to provide an indication to the wearer that a condition requiring attention has been detected. The tag can also include a panic button to allow the wearer to alert the data center that a situation requiring attention exists. This button can be particularly useful when the tag is used by an individual being monitored because of the individuals potential need for assistance.

Figure 3:
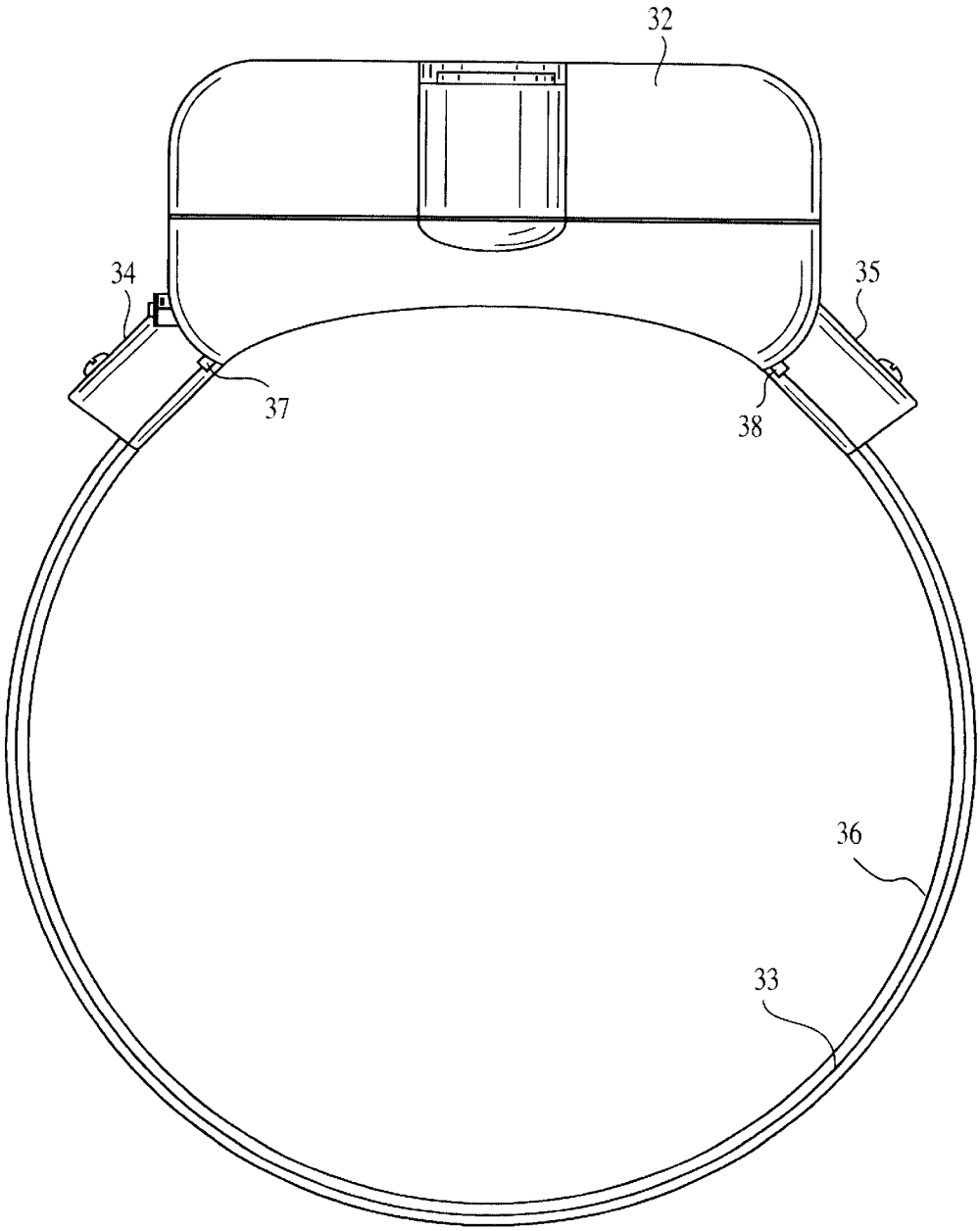
FIG. 3 illustrates an exemplary embodiment of a tamper detection mechanism which can be incorporated into the present invention.

As illustrated in FIG. 3, the main housing 32 of the device is curved on the side facing the wearer's limb. Two curved strap connectors 34 and 35 extend form the sides of the main housing 32 and are also curved to conform generally to the shape of the wearer's limb. A strap 36 is used to mold the tag in position on the wearer's limb by attachment at each end to connectors 34 and 35. The tamper prevention includes a single fiber optic cable 33 which is incorporated into the molded flexible strap 36 that holds the unit 32 onto the wearer. An infra red transmitter LED 37 is positioned at one end of the fiber. The transmitter LED 37 is used to send a pulsed signal through the fiber. An infrared detector 38 is positioned at the other end of the fiber to receive the signals. If the signal path is broken or disturbed, the infrared receiver will not receiver the proper pulsed signal and a tamper message will be transmitted to the data center to indicate a taper condition. The strap can alternatively be used with more than on fiber optic cable and IR transmitter/receiver pair.

The operation of the tag is controlled using software embedded in the flash memory 14. The flash memory can be reprogrammed to enable the tag for different applications. Minor modifications to the software allow the tag's operational characteristics to be changed while being used for the same applications. Variables in the control program such as timings and monitoring can be defined and redefined by programing the flash memory 14.

The monitoring center 30, provides control and monitoring of tags 10. Commands and data signals transmitted between the tags 10 and the monitoring center 30 can utilize the SMS messaging over the GSM cellular network or any suitable alternative available for wireless communication. The tags and the monitoring center require a number of commands and responses for proper monitoring of the tag wearers corresponding to the restriction parameters. The passing of commands and data between the tags 10 and the monitoring center 30 require that the commands and data messages include the correct password so that commands and data can be verified. Password protection for each message is important to prevent the offenders from circumventing the system by provisioning of false wireless messages.

Each tag monitored by a monitoring center is assigned a unique identifier so that wireless messages from a tag can be identified as originating from a particular tag. The monitoring center will define inclusion and/or exclusion zones for each tag corresponding to the confinement parameters of the offender wearing the tag. Exclusion/inclusion of zones can include both geographical and temporal parameters. For example, and offender may be excluded from a certain location only during certain times in the day and may be required to be included at certain location during certain prescribed periods of the day. The parameters of the inclusion and exclusion zones for each tag are stored at the monitoring center and in the memory 14 of the tag.

The monitoring center 30 will periodically send a request position message to a tag. The sending of a request position message will depend upon the parameters of the offender wearing the tag. The terms of monitoring may be set by the confining authority or they may be set based upon the knowledge of the system. Monitoring parameters can also be altered based upon experience with a particular offender. For example, an offender with a better compliance history may receive less frequent requests for position information than an offender with a poor compliance history.

When a request position message is received, the processor 12 will activate the GPS receiver and the GPS receiver 16 will attempt to obtain a valid positional fix for the tag. Once a valid fix has been obtained and/or confirmed, the tag will transmit the tag's positional information to the monitoring center. The tag may also send its position based upon the determination by cellular ID and EOTD. The GPS is given a fixed time period to obtain positional information. If a fix is not obtained within an allotted time period, the tag will return the GPS to sleep and send a message to the monitoring center 30 indicating that a GPS fix was not obtained and providing the monitoring center 30 with the current cell ID value of the tag. The tag may be programed to automatically retry to obtain an GPS fix and return the information to the monitoring center if a fixed is obtained. Alternatively, the tag may be programmed to maintain the GPS inactive until the monitoring center sends another position request message.

Each tag is also programmed with a tag wake period and a tag sleep period. The tag sleep period switches the tag off for a pre-determined period of time. All of the tag components are put into a low power mode to conserve battery power. At the end of the sleep period, the wireless modem 18 will wake and send a wake message to the monitoring center 30. The monitoring center will know that the tag has been in sleep mode and is now in wake mode. The monitoring center can then repeat any necessary and/or unanswered messages. The wireless modem 18 will check for messages and process any messages. Once all messages have been processed, the tag can automatically return to sleep mode for the predefined period of time.

The tag will also wake and reestablish communication in the event of an internal alarm such as detection of a tamper condition or the need for recharging.

The tag can also have a preprogrammed wake mode time period. If the Tag does not receive and process messages after a sleep mode, it may still be desirable to maintain the tag in a wake condition for a predefined period of time.

When a condition exists for the tag to send an alert or an alarm to the monitoring center, the tag will repeat the alert and/or alarm at regular intervals until an alert/alarm acknowledgment is received by the tag. Alarms can include exclusion or inclusion violations, strap tamper detection or low battery condition. In the event of a low battery condition, the alarm will no longer be sent once the unit is connected for recharging even though no acknowledgment has been received from the monitoring center 30. The tag can also be programmed to cancel the low battery message by sending a recharging messaging to the monitoring center 30.

Position from the cellular GSM network is available through a number of different technologies, dependent upon the network service provider. The request for location is generally made by sending a message to the location center operated by the network service provider. The result of the location request is then sent back to the wireless modem in the tag and forwarded onto the monitoring center 30. Because the GPS location is limited when indoors, it may be necessary to rely upon GSM location techniques which can operate in some situations where the GPS receiver 16 fails to acquire a satellite.

Because both the tag and the monitoring center have the appropriate exclusion and inclusion zones and times independently stored in their respective memories, either the tag or the monitoring center or both can generate an exclusion/inclusion violation alarm. Exclusion and/or inclusion violations will be repeated until an acknowledgment of receipt is received by the generator of the alarm. The tamper alarms will also be sent to the monitoring center from the tag when tampering is detected and will be repeated at regular short intervals until such tampering is a knowledge by the monitoring center.

The tag can also be programmed to provide an over voltage message to the monitoring center 30 based upon the fuse 28, to indicate improper charging or attempted tampering. Exclusion and inclusion parameters can be modified from time to time by the monitoring center and downloaded to the tag to update the parameters stored in flash memory 14.

Because of the various power requirements of the different components within the tag 10, the activation and/or deactivation of different components within the tag must be carefully controlled by the processor 12, to maximize the battery life between charges. The GPS and GSM modules in the tag have the highest power requirements so that the period of the battery life will depend upon the use of these two components because of the large power consumption's required in transmitting and receiving. Therefore, the number of location fixes and calls to the monitoring center 30 are carefully managed by the processor to minimize power usage by the tag 10.

When determining the position of the tag, the processor can operate on a fuzzy logic basis to attempt to determine and/or verify tag location. The tag will collect location data from both the GPS signal and the cellular system. The tag can then weigh the location information from each of these sources to determine a probability of actual location. The weighted determination, as well as the original positional information gathered by the tag, is transmitted to the monitoring center 30. The monitoring center receives this information from all of the tags in the monitored area and combines this information into a large-scale database. The monitoring center can then make a refined determination of the location of each tag based upon the historical location of each tag and the overall correlation between GPS indicated location and cellular system location information.

The monitoring center, having a large number of data points spread over a wider geographical area can make more sophisticated determinations of the validity of the GPS and/or cellular system location data. The refined estimates, if different from the initial determination by the tag, can then be provided to the tag for retention and enhanced location determination.

The system of the exemplary embodiment monitors movements of individuals. Anyone skilled in the art will realize that the inventive concept taught herein applies equally well to locating a population of individuals or objects (such as cars or boats) Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

We claim:

1. A one-piece lightweight personal tracking tag, comprising:

a main housing having a contoured surface;

a processor housed within said main housing;

flash memory connected to said processor and housed within said main housing;

a global positioning satellite (GPS) receiver housed within said main housing to obtain geographic location information;

a wireless modem housed within said main housing for two way communication with a wireless network to exchange data with a centralized data system connected to said wireless network, wherein the processor determines a geographic position of the tag to verify the tag location through collection of location data from both said geographic location information from said GPS receiver and a geolocation implemented through the wireless network, weighs the location data from each of these sources to determine a probability of actual location, and transmits said weighted determination of the location data, as well as original geographical positional information gathered by the tag, to said centralized data system using said wireless modem.

2. The tag of claim 1, wherein:

said global positioning satellite receiver is connected to said processor and provides said obtained geographic location information to said processor;

said processor monitors said geographic positional information provided by said global positioning satellite receiver to monitor said tag location, compares said monitored tag location to a database of acceptable and unacceptable location and time parameters stored in said flash memory and provides geographic location updates to said centralized database system.

3. The tag of claim 2, wherein:

said tag reports into said centralized database on a periodic basis.

4. The tag of claim 3, wherein:

said reporting can be on a predetermined schedule and/or can be based upon detection of a violation or other reportable condition detected by the tag itself.

5. The tag of claim 2, wherein:

said processor receives downloads and updates from said centralized database system.

6. The tag of claim 1, further comprising:

a rechargeable battery housed within said main housing;

a recharging connector attached to said rechargeable battery; and a waterproof seal maintaining the interior of said main housing waterproof.

7. The tag of claim 1, further comprising:

cellular wireless geolocation based means for determination of the geographic location of said tag.

8. The tag of claim 1, further comprising:

strap connectors attached to said main housing;

a strap having a first end removably connected to one of said strap connectors and a second end connected to another of said strap connectors for mounting said main housing on an individual;

a communication fiber embedded within said strap for maintaining communication between a signal emitter connected at one end of said fiber and a signal receiver at the opposite end of said fiber;

tamper detection circuit for determining if the connection between said signal emitter and said signal receiver has been interrupted indicating a disconnection of said strap.

9. The tag of claim 1, wherein said centralized database combines said transmitted weighted data and said geographical position information into a geographical database comprising positional data points spread over a geographical area, receives transmitted weighted data and geographic positional information from a plurality of personal tracking tags in a monitored area.

10. The tag of claim 9, wherein said centralized database makes a refined determination of the location of said tag based upon the historical location of each tag and a correlation between the GPS indicated location data and wireless network location data of each tag.

11. The tag of claim 10, wherein said centralized database provides said refined determination information and geographical database parameters to each of said tags for enhanced location determination by said tags.

12. A system for monitoring the location of individuals, comprising:

a centralized database system for maintaining a database of specified parameters for a plurality of offenders;

a plurality of mobile tags each assigned to one of said plurality of offenders, each tag having:

a main housing having a contoured surface;

a processor housed within said main housing;

flash memory connected to said processor and housed within said main housing;

a global positioning satellite receiver housed within said main housing to obtain geographic location information and connected to said processor to provide said obtained geographic location information to said processor;

a wireless modem housed within said main housing for two way communication with a wireless network to exchange data with said centralized database connected to said wireless network, wherein said processor monitors said geographic positional information provided by said global positioning satellite receiver to monitor said tag location, compares said monitored tag location to a database of acceptable and unacceptable location and time parameters stored in said flash memory and provides geographic location updates to said centralized database system and receives downloads and updates from said centralized database, wherein the processor determines a geographical position of the tag utilizing fuzzy logic to verify tag location through collection of location data from both the GPS signal and geolocation implemented through the cellular system, and weighs the location data from each of these sources to determine a probability of actual location, wherein said weighted determination of the location data, as well as original geographical positional information gathered by the tag, is transmitted to said centralized database by said wireless modem, wherein said centralized database:

receives geographical positional information from each of said tags;

combines said geographical information into a geographical database comprising a large number of data points spread over a geographical area, and makes a refined determination of the location of each tag based upon the historical location of each tag and the overall correlation between GPS indicated location and cellular system location information based upon said geographical database.

13. The system of claim 12, wherein:

each of said tags reports into said centralized database on a periodic basis;

information reported by said tags is recorded and analyzed by said centralized database to determine if offender violations have occurred;

said centralized database executes an appropriate response to the analysis of the reported data.

14. The system of claim 12, wherein:

each tag is assigned a unique identifier;

the centralized database contains inclusion and/or exclusion zones for each tag corresponding to confinement parameters; and said centralized database periodically sends a position request to one or more of said plurality of tags.

15. The system of claim 12, wherein:

said tag provides a violation condition signal to said centralized database whenever said monitoring of said geographic positional information indicates a violation of the restriction parameters associated with the tag's associated offender.

16. The system of claim 12, wherein:

said centralized database provides said refined determination information and large-scale database parameters to each of said tags for enhanced location determination by said tags.

17. The system of claim 12, wherein:

said central database can command one or more of said tags to enter a sleep mode wherein said tag is inactive, until receipt of a reactivation command, a predetermined period of time or until the detection of another predefined reactivation event.

* * * * *